United States Patent [19]

Keil

[11] 4,443,351

[45] Apr. 17, 1984

[54] SILICONE HYDRAULIC FLUIDS AND ADDITIVE CONCENTRATES THEREFOR

[75] Inventor: Joseph W. Keil, Midland, Mich.

[73] Assignee: Dow Corning Corporation, Midland, Mich.

[21] Appl. No.: 437,986

[22] Filed: Nov. 1, 1982

[51] Int. Cl.[3] ..... C10M 3/44; C10M 1/50

[52] U.S. Cl. ..... 252/75; 252/32.7 E; 252/49.6; 252/78.3; 556/451; 556/453; 556/456; 556/459

[58] Field of Search ..... 252/32.7 E, 49.6, 75, 252/78.3; 556/451, 453, 456, 459

[56] References Cited

U.S. PATENT DOCUMENTS

| | | | |
|---|---|---|---|
| 2,495,362 | 1/1950 | Barry et al. | 556/456 |
| 3,308,093 | 3/1967 | Lentz | 252/78.3 |
| 3,759,827 | 9/1973 | Groenhof et al. | 252/29 |
| 4,097,393 | 6/1978 | Cupper et al. | 252/78.3 |
| 4,137,189 | 1/1979 | Holbrook et al. | 252/75 |
| 4,155,864 | 5/1979 | Martin | 252/78.3 |
| 4,357,252 | 11/1982 | Huber et al. | 252/78.3 |

FOREIGN PATENT DOCUMENTS 1535265 2/1976 United Kingdom .

*Primary Examiner*—John E. Kittle
*Assistant Examiner*—Robert A. Wax
*Attorney, Agent, or Firm*—Andrew H. Ward; George A. Grindahl

[57] ABSTRACT

Compositions are disclosed consisting essentially of: (A) a polydiorganosiloxane fluid in which the organic radicals are predominantly or wholly methyl radicals; (B) a chlorendate diester; (C) a lubricant compound which is an antimony or lead compound of a dialkyldithiocarbamate or dialkylphosphorodithioate; and (D) a block copolymer comprising blocks of polydimethylsiloxane and blocks of polybutadiene or hydrogenated polybutadiene. These compositions are useful as concentrates for replenishing polydiorganosiloxane hydraulic fluids that have become depleted in additives (B) and (C), and as hydraulic fluids having improved resistance to settling of the lubricant compound at low temperatures.

22 Claims, No Drawings

SILICONE HYDRAULIC FLUIDS AND ADDITIVE CONCENTRATES THEREFOR

BACKGROUND OF THE INVENTION

Hydraulic systems, in which power is transferred from one place to another, are used extensively in industrial equipment, farm equipment, transportation equipment, and the like. Illustrative of such equipment are lifters, jacks, elevators, mills, presses, and braking and power steering systems for vehicles.

High pressures and temperatures, which are frequently present in hydraulic systems, place high demands on the thermal and oxidative stability of the fluid used as the hydraulic medium. In addition, the lubricity of the hydraulic fluid is especially important with hydraulic systems wherein a pump is used to pressurize or move the hydraulic fluid from one place to another.

Polydiorganosiloxanes have been recognized as having exceptional thermal and oxidative stability, compatibility with seal materials, and high viscosity indices, said properties making them potentially useful as hydraulic fluids.

Unfortunately, the generally low surface tension of polydiorganosiloxanes tends to cause them to have marginal lubricity on metals. As a result, additives improving the lubricity of polydiorganosiloxanes have been sought.

Groenhof et al., in U.S. Pat. No. 3,759,827 disclose the use of a chlorendate diester to improve the lubricity of a polydiorganosiloxane fluid.

Page et al., U.K. Pat. No. 1,535,265, disclose improved silicone hydraulic fluids which comprise a siloxane fluid, a chlorendate diester, and a lubricant additive compound selected from dithiocarbamates and phosphorodithioates of antimony and lead. The stability of these additives to settling at room temperature and below room temperature, however, is limited.

Holbrook et. al., in U.S. Pat. No. 4,137,189, disclose improved silicone hydraulic fluids which comprise a non-linear siloxane fluid, a chlorendate diester and a lubricant additive compound selected from dithiocarbamates and phosphorodithioates of antimony and lead. The compositions of Holbrook et al. have enhanced stability to settling, as evidenced by improved cloud point temperatures. However, a non-linear siloxane of the type used by Holbrook et al. is more expensive to manufacture than a linear polymer. In addition, the concentration of additives it is possible to incorporate into the compositions of Holbrook et al., and still retain a non-settling hydraulic fluid, is still somewhat limited.

Martin, in U.S. Pat. No. 4,155,864 discloses the incorporation of small amounts of polydimethylsiloxane gum into silicone dielectric fluids. Said incorporation can also be beneficial in other silicone compositions, such as heat transfer fluids, hydraulic fluids and the like.

Although the silicone hydraulic fluid compositions of the art discussed above have been widely accepted, there still exists a need for a silicone hydraulic fluid composition which has better stability to settling at room temperature and at lower temperatures. There also exists a need for an additive concentrate composition which can be used to rejuvenate spent silicone hydraulic fluid compositions.

In large hydraulic equipment installations, common accumulators and reservoirs for hydraulic fluid are often used. To compensate for leakage losses, it is convenient to add makeup fluid to the reservoir as it is needed. In addition, since the lubricant additives can become depleted through use, it would be highly desirable to have a composition more concentrated than the fluid with respect to the lubricant additives. Such a concentrate could be used both to replenish the reservoir, and at the same time, to raise the total concentration of lubricant additives to the desired level. So far as is known, such a concentrate is not currently available because of the settling problem discussed above.

SUMMARY OF THE INVENTION

It is an object of the present invention to provide improved polydiorganosiloxane hydraulic fluid compositions. It is another object of the present invention to provide polydiorganosiloxane concentrates of lubricant additives. Another object is to provide polydiorganosiloxane hydraulic fluid compositions having good lubricating properties. A further object is to provide an hydraulic fluid which has settling stability over a wide range of temperature. Another object is to provide an improved process for transmitting power from one place to another place via an hydraulic fluid. A further object is to provide a method for preparing improved polydiorganosiloxane hydraulic fluids.

These and other objects are realized by the present invention, wherein it has been discovered that block copolymers containing blocks of polydimethylsiloxane and blocks of polybutadiene or hydrogenated polybutadiene, when added to polydiorganosiloxane hydraulic fluid compositions, make possible much higher concentrations of lubricant additives in the fluid than has heretofore been possible.

In one aspect of the present invention, polydiorganosiloxane hydraulic fluids and polydiorganosiloxane hydraulic fluid additive concentrates are provided.

In another aspect of the present invention, a method is provided for preparing improved polydiorganosiloxane hydraulic fluids using the polydiorganosiloxane fluid additive concentrates of the present invention.

In yet another aspect of the present invention, a method is provided for transmitting power from one place to another place using the polydiorganosiloxane hydraulic fluid compositions of this invention.

DETAILED DESCRIPTION OF THE INVENTION

The present invention relates to a composition consisting essentially of (A) 50 to 96 parts by weight of a polydiorganosiloxane having a viscosity of from about $1.00\times10^{-5}$ $m^2$/second to about $1.00\times10^{-4}$ $m^2$/second at 25° C., said polydiorganosiloxane having the formula $R'R_2SiO(Me_2SiO)_x(MeRSiO)_ySiR_2R'$, wherein Me represents the methyl radical, each R represents a monovalent radical selected from the group consisting of hydrocarbon radicals containing from 1 to 6 carbon atoms, and halogenated hydrocarbon radicals containing from 1 to 6 carbon atoms, each R' represents a radical selected from the group consisting of R radicals, the hydride radical, and the hydroxy radical, x has an average value of 8 or more and y has an average value of from 0 to about 2, (B) 2.5 to 40 parts by weight of a chlorendate diester having the formula $R''O_2CQCO_2R''$, wherein $—O_2CQCO_2—$ represents the chlorendate residue,

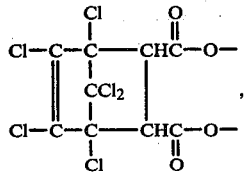

and each R'' represents a radical selected from the group consisting of alkyl radicals containing from 4 to 10 carbon atoms and the tetrahydrofurfuryl radical, (C) 0.5 to 20 parts by weight of a lubricant compound selected from the group consisting of N,N-dialkyldithiocarbamates of lead and antimony, and dialkylphosphorodithioates of lead and antimony, and (D) 1 to 10 parts by weight of a block copolymer comprising from about 65% by weight to about 90% by weight polydimethylsiloxane blocks, and from about 10% by weight to about 35% by weight polybutadiene or hydrogenated polybutadiene blocks, the total parts of (A) plus (B) plus (C) plus (D) being 100 parts by weight.

The polydiorganosiloxane, component (A) in the compositions of the present invention, is represented by the formula $R'R_2SiO(Me_2SiO)_x(MeRSiO)_ySiR_2R'$, wherein Me represents the methyl radical, R is an aliphatic monovalent radical selected from the group consisting of hydrocarbon radicals containing from 1 to 6 carbon atoms and halogenated hydrocarbon radicals containing from 1 to 6 carbon atoms, R' is a radical selected from the group consisting of R radicals as recited above, the hydride radical, and the hydroxy radical, x has an average value of 8 or more and y has an average value of from 0 to about 2.

Examples of suitable R hydrocarbon radicals containing from 1 to 6 carbon atoms include methyl, ethyl, propyl, isobutyl, pentyl, isopentyl, neopentyl, hexyl, vinyl, and allyl. Halogenated hydrocarbon radicals consist of hydrocarbon radicals are hereinabove delineated in which one or more of the hydrogen atoms has been replaced by a halogen atom, such as fluorine, chlorine, or bromine. Examples of halogenated hydrocarbon radicals include chloromethyl, 3 chloropropyl, and 3,3,3 trifluoropropyl.

Although not desired, small amounts of aromatic hydrocarbon substituents are not thought to adversely affect the usefulness of the compositions of the present invention. Examples of aromatic hydrocarbon substituents are phenyl, tolyl, mesityl, and napthyl.

The viscosity of polydiorganosiloxane component (A) is from about $1.00\times10^{-5}$ m²/second (10 centistokes) to about $1.00\times10^{-4}$ m²/second (100 centistokes) at 25° C. Preferably, the viscosity of polydiorganosiloxane component (A) is from about $2.00\times10^{-5}$ m²/second to about $5.00\times10^{-5}$ m²/second (20 to 50 centistokes) at 25° C.

The desired viscosity of polydiorganosiloxane component (A) can be obtained by careful selection of x and y in the above formula for said component (A), or the desired viscosity can be obtained through mixing two or more appropriate polydiorganosiloxanes. For example, a small amount, such as 1% or 3% by weight, of a high molecular weight polydiorganosiloxane having a viscosity in excess of 1.0 m²/second at 25° C. can be mixed with 97% or 99% of a low molecular weight polydiorganosiloxane having a viscosity of $1.00\times10^{-5}$ m²/second or less, resulting in a mixture of polydiorganosiloxanes, said mixture having a viscosity between about $1.00\times10^{-5}$ m²/second and $1.00\times10^{-4}$ m²/second.

The polydiorganosiloxanes for use as component (A) in the compositions of the present invention consist of those polydiorganosiloxanes of the above formula in which most of the radical substituents are methyl radicals. Preferably, the polydiorganosiloxane used as component (A) in the compositions of the present invention is trimethylsiloxy-endblocked polydimethylsiloxane.

Suitable methods for synthesis of polydiorganosiloxanes for use as component (A) in the compositions of the present invention are well known. Illustrative of suitable synthetic methods is the cohydrolysis and subsequent condensation of appropriately selected diorganodialkoxysilanes or diorganodichlorosilanes, along with desired amounts of $R'R_2SiX$ species, wherein R' and R are as hereinabove defined and X represents a hydrolyzable group, such as a halide group, such as chlorine, fluorine or bromine; or an alkoxy group, such as methoxy, or ethoxy. Another suitable synthetic method is the acid or base catalyzed equilibration of diorganocyclosiloxanes and a $R'R_2SiX$ species as hereinabove defined.

The chlorendate diester, component (B) in the compositions of the present invention, has the formula $R''O_2CQCO_2R''$, wherein $—O_2CQCO_2—$ represents the chlorendate residue:

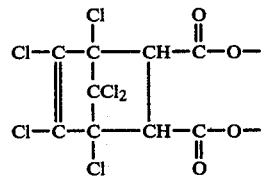

and wherein each R'' is selected from the group consisting of alkyl radicals containing from 4 to 10 carbon atoms, and the tetrahydrofurfuryl radical. Examples of said alkyl radicals are butyl, pentyl, hexyl, heptyl, octyl, 2-ethylhexyl, nonyl, decyl, and the like. Chlorendate diesters in which each R'' is selected from the group consisting of the butyl radical and the 2-ethylhexyl radical are preferred in the compositions of the present invention.

Chlorendate diesters are well-known materials; many are commercially available. Their preparation needs no further elaboration herein. The preferred chlorendate diesters are commercially available from, for example, the Velsicol Chemical Corporation of Chicago, IL.

The lubricant compound, component (C) in the compositions of the present invention, is selected from the lead and antimony compounds of N,N-dialkyldithiocarbamates and the lead and antimony compounds of dialkyl phosphorodithioates. These compounds have the general formulae:

$$((R'''O)_2P\overset{S}{\overset{\|}{}}S)_3Sb,\ ((R'''O)_2P\overset{S}{\overset{\|}{}}S)_2Pb,$$

$$(R'''_2NC\overset{S}{\overset{\|}{}}S)_3Sb,\ \text{and}\ (R'''_2NC\overset{S}{\overset{\|}{}}S)_2Pb,$$

wherein each R''' is selected from the group consisting of alkyl radicals containing from 4 to 10 carbon atoms. Examples of alkyl radicals containing from 4 to 10 carbon atoms include butyl, 2-ethylhexyl, pentyl, hexyl, heptyl, nonyl, decyl, and the like. 2-ethylhexyl is the preferred R''' radical for the lubricant compound, component (C) in the compositions of the present invention.

The lubricant compounds that are used as component (C) in the compositions of the present invention are well-known materials in the lubricant art; many are commercially available. Their preparation needs no further elaboration herein. The preferred lubricant compounds are commercially available from, for example, the Vanderbilt Company of Norwalk, CT.

The block copolymer, component (D) in the compositions of the present invention, consists of, on average, at least one block of polydimethylsiloxane covalently bonded through one of its terminal units to a terminal unit of at least one block of polybutadiene or hydrogenated polybutadiene.

Blocks are defined herein as molecular units of homogeneous composition consisting of an integer number of segments, each segment having substantially the molecular weight of the corresponding starting material in the synthesis of the block copolymer, described hereinbelow.

Each polydimethylsiloxane block consists of one or more polydimethylsiloxane segments. The average molecular weight of the polydimethylsiloxane segments is from about 1,000 to about 10,000 and more preferably from about 1,800 to about 3,600. Polydimethylsiloxane blocks are represented herein by A.

Each polybutadiene or hydrogenated polybutadiene block consists of one or more polybutadiene or hydrogenated polybutadiene segments. The average molecular weight of said segments is from about 1,000 to about 8,000 and more preferably from about 1,000 to about 4,000. Polybutadiene or hydrogenated polybutadiene blocks are represented herein as B.

Possible block configurations for the block copolymers used in the compositions of the present invention include $(AB)_n$, $(BAB)_n$, and $(ABA)_n$, wherein n is an integer. Illustrative, but not limiting, are the following possible block configurations: AB; ABAB; ABA; ABABA; BAB; BABAB; ABABABA; and the like.

The specific arrangement of the blocks within the copolymer is not thought to be critical, so long as, on average, at least one polydimethylsiloxane block is convalently bonded to at least one polybutadiene or hydrogenated polybutadiene block.

The block copolymers used as component (D) in the compositions of the present invention contain an amount of polydimethylsiloxane segments from about 65% to about 90% by weight, and more preferably from about 70% to about 90% by weight. Said copolymers contain an amount of polybutadiene or hydrogenated polybutadiene segments from about 10% to about 35% by weight, and more preferably from about 10% to about 30% by weight.

Small amounts, such as 5% or 10% by weight, of polybutadiene or hydrogenated polybutadiene homopolymer are not thought to affect the utility of the compositions of the present invention.

While the block copolymers used in the compositions of the present invention can be made by several suitable copolymerization techniques, such as sequential anionic polymerization of the appropriate monomers, the best method of preparing said block copolymers that is known at the present time is co-condensation of polydimethylsiloxane segments with polybutadiene or hydrogenated polybutadiene segments through mutually coreactive end groups.

For example, hydroxy-endblocked polybutadiene segments, or hydroxy-endblocked polybutadiene segments that have been hydrogenated, can be co-condensed with polydimethylsiloxane segments having silicon-bonded hydrolyzable radicals at one or both terminal ends of said polydimethylsiloxane segments.

Suitable hydroxy-endblocked polybutadiene segments are commercially available, and can be obtained, for instance, from the Arco Chemical Company of Philadelphia, PA. Suitable hydrogenated hydroxy-endblocked polybutadiene segments are commercially available, and can be obtained from Nissho Iwai American Corp. of New York, N.Y. Alternatively, hydroxy-endblocked polybutadiene segments can be prepared by such methods as anionic polymerization of butadiene with a bifunctional initiator, followed by termination of the polymerization with ethylene oxide, and subsequent hydrolysis of the terminal ends, to produce hydroxy-endblocked polybutadiene segments. Said polybutadiene segments can then be wholly, substantially, or partially hydrogenated by well known methods to remove residual unsaturation, if desired. By hydrogenated it is meant herein wholly, substantially, or partially hydrogenated.

Polydimethylsiloxane segments containing silicon-bonded hydrolyzable end groups are well known in the organosilicon art. Examples of suitable silicon-bonded hydrolyzable end groups include hydroxy groups; alkoxy groups, such as methoxy, ethoxy, or isopropoxy; halo groups, such as fluoro, chloro, or bromo; amido groups, such as N-methylacetamido; oximo, such as methylketoximo; aminoxy groups such as diethylaminoxy; acyl groups, such as acetyl, propionyl, benzoyl; and the like.

The polydimethylsiloxane segments, and the polybutadiene or hydrogenated polybutadiene segments, with mutually coreactive end groups, can be co-condensed by direct reaction with one another, or said segments can be co-condensed by means of an appropriate coupling agent. Silanes bearing two silicon-bonded hydrolyzable groups as hereinabove defined are appropriate coupling agents.

After co-condensing the above segments with mutually coreactive end groups, any co-condensation byproducts can be removed by separation means, such as distillation. If the co-condensation byproduct has no substantially deleterious effect in a subsequently prepared hydraulic fluid, it can be simply left in the block copolymer.

A convenient method of synthesis for the block copolymers used in the compositions of the present invention is co-condensation of hydroxy-endblocked polydimethylsiloxane segments with hydroxy-endblocked polybutadiene segments or hydrogenated hydroxy-endblocked polybutadiene segments.

Co-condensation of the above dihydroxy-ended polymers is preferably conducted in a solvent, such as an aromatic hydrocarbon solvent, such as benzene, toluene, or xylene; or an aliphatic hydrocarbon solvent, such as pentane, hexane or heptane. While the relative amount of solvent used is not narrowly critical, from 10 to 50 parts by weight of the polymeric starting materials and 50 to 90 parts by weight of solvent, are appropriate, said parts being based upon 100 total parts for said materials plus said solvent.

Said solvent can be removed from the block copolymer produced in the co-condensation reaction by separation means, such as distillation. Advantageously, said solvent and any co-condensation byproduct, can be removed from the block copolymer simultaneously by distillation.

The co-condensation reaction can be catalyzed by effective amounts of a condensation catalyst. Appropriate catalysts include the polydimethylsiloxane-soluble salts of Pb, Fe, Co, Zr, Ti, Mn, and Sn, such as stannous octoate, dibutyltindilaurate and the like, amines, and weak organic acids and their alkali metal salts, such as the sodium and potassium salts of acetic acid.

Suitable methods of analyzing and characterizing the block copolymers used in the composition of the present invention include: molecular weight determination by gel permeation chromatography of said copolymer and comparison of the resultant chromatogram with the chromatograms of known standards; identification of chemical groups present by methods well known in nuclear magnetic resonance spectroscopy and infrared spectroscopy; elemental analysis of the block copolymer; and other well-known analytical techniques.

Compositions of the present invention which consist essentially of 100 parts of: 50 to less than 84.5 parts by weight of component (A), greater than 10 to about 40 parts by weight of component (B), greater than 2.5 to about 20 parts by weight of component (C), and greater than 3 to about 10 parts by weight of component (D), are useful and valuable polydiorganosiloxane hydraulic fluid additive concentrates. Said concentrates can be used to replenish a polydiorganosiloxane hydraulic fluid that has become depleted in components (B) and/or (C) by simple addition of said concentrate, in the appropriate amount, to said depleted polydiorganosiloxane hydraulic fluid. For example in this regard, polydiorganosiloxane hydraulic fluid additive concentrates of the present invention can be added to the polydiorganosiloxane hydraulic fluids of the art, such as those disclosed by Groenhof et al., U.S. Pat. No. 3,759,827, or by Page et al., U.K. Pat. No. 1,535,265, or they can be added to the hydraulic fluid compositions of the present invention.

Additionally, said concentrates can be added to appropriate amounts of component (A) to produce the polydiorganosiloxane hydraulic fluid compositions of the present invention, as hereinbelow delineated.

The polydiorganosiloxane hydraulic fluid additive concentrates of the present invention are prepared by mixing appropriately selected quantities of components (A), (B), (C), and (D) together. Mixing can be accomplished by heating said components together, such as heating said components together at a temperature of about 70° C., and holding said components together at that temperature for a period of time from about 1 minute to about 30 minutes in duration. Alternatively, mixing can be accomplished by agitation of said components together. For example, said components can be mixed together by means of a high shear mixer, such as an Eppenbach® mixer. Of course, mixing can be accomplished by heating and agitating. Agitation, with or without heating, is a preferred method for preparation of the polydiorganosiloxane hydraulic fluid concentrates of the present invention.

The polydiorganosiloxane hydraulic fluid concentrates of the present invention often settle upon standing for a period of time at room temperature. Said settling is believed to be precipitation of a small portion of component (C). Remixing of a settled concentrate can be effected by simple low-shear stirring. Hydraulic fluid compositions of the present invention do not settle even after standing for prolonged periods of time at room temperature.

Compositions of the present invention which consist essentially of 100 parts of: 84.5 to 96 parts by weight of component (A), 2.5 to 10 parts by weight of component (B), 0.5 to 2.5 parts by weight of component (C), and 1 to 3 parts by weight of component (D), comprise useful and valuable hydraulic fluid compositions.

Hydraulic fluid compositions of the present invention can be prepared by mixing appropriately selected amounts of components (A), (B), (C), and (D) together. Said mixing can be accomplished by heating the components together, such as heating the components to 70° C. and holding them at that temperature for a period of time from about 1 minute to about 30 minutes in duration. Alternatively, said mixing can be accomplished by agitation of components (A), (B), (C), and (D) together in a vessel agitated by a high shear rate mixer, such as an Eppenbach® mixer. Of course, said mixing can be accomplished by heating and agitation.

Alternatively, and preferably, the hydraulic fluid compositions of the present invention are prepared by admixture of additional component (A) with an appropriately selected hydraulic fluid additive concentrate of the present invention, delineated above. Surprisingly, it has been found that when the hydraulic fluid compositions of the present invention are prepared by this preferred method, the resulting hydraulic fluid composition has significantly better lubricity, as measured by the Shell Four Ball method, delineated below, than the same hydraulic fluid composition of this invention that has been prepared by mixing all of the components simultaneously.

Accordingly, the present invention further relates to a method for producing polydiorganosiloxane hydraulic fluids, said method comprising mixing together (I) from 70 to 85 parts by weight of a polydiorganosiloxane having a viscosity of from about $1.00\times10^{-5}$ m$^2$/second to about $1.00\times10^{-4}$ m$^2$/second at 25° C., said polydiorganosiloxane having the formula $R'R_2SiO(Me_2SiO)_x(MeRSiO)_ySiR_2R'$ wherein Me represents the methyl radical, each R represents a monovalent radical selected from the group consisting of hydrocarbon radicals containing from 1 to 6 carbon atoms, and halogenated hydrocarbon radicals containing from 1 to 6 carbon atoms, each R' represents a radical selected from the group consisting of R radicals, the hydride radical, and the hydroxy radical, x has an average value of 8 or more and y has an average value of from 0 to about 2, and (II) from about 15 to about 30 parts by weight of a composition consisting essentially of (A) 50 to less than 84.5 parts by weight of a polydiorganosiloxane having a viscosity of from about $1.00\times10^{-4}$ m$^2$/second at 25° C., said polydiorganosiloxane having the formula $R'R_2SiO(Me_2SiO)_x(MeRSiO)_ySiR_2R'$, wherein Me represents the methyl radical, each R represents a monovalent radical selected from the group consisting of hydrocarbon radicals containing from 1 to 6 carbon atoms, and halogenated hydrocarbon radicals containing from 1 to 6 carbon atoms, each $R^1$ represents a radical selected from the group consisting of R radicals, the hydride radical, and the hydroxy radical, x has an average value of 8 or more and y has an average value of from 0 to about 2, (B) from greater than 10 to 40 parts by weight of a chlorendate diester having the formula $R''O_2C$-$QCO_2R''$, wherein $—O_2CQCO_2—$ represents the chlorendate residue,

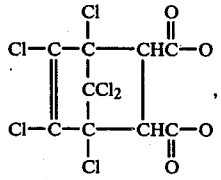

and each R'' represents a radical selected from the group consisting of alkyl radicals containing from 4 to 10 carbon atoms and the tetrahydrofurfuryl radical, (C) from greater than 2.5 to 20 parts by weight of a lubricant compound selected from the group consisting of N,N-dialkyldithiocarbonates of lead and antimony, and dialkylphosphorodithioates of lead and antimony, and (D) from greater than 3 to 10 parts by weight of a block copolymer comprising from about 65% by weight to about 90% by weight polydimethylsiloxane blocks, and from about 10% by weight to about 35% by weight polybutadiene or hydrogenated polybutadiene blocks, the total parts of (A) plus (B) plus (C) plus (D) being 100 parts by weight, and the total parts of (I) plus (II) being 100 parts by weight.

Said mixing together of component (I) and component (II) can be accomplished by placing said two components together, and applying to said two components suitable mixing means. Suitable mixing means include low shear mixers, such as paddle stirrers impelled by motors, helical stirrers impelled by motors, and the like. Of course, high shear mixing means, such as an Eppenbach mixer are also suitable. Other suitable mixing means will be apparent to those skilled in the art.

Small amounts of non-essential components, such as colorants, spray flammability resistance additives, fire retardants, and the viscosity control additives can be added to the polydiorganosiloxane hydraulic fluid compositions of the present invention. Examples of such non-essential additives include dyes, to make the hydraulic fluid more readily identifiable, and highly brominated compounds to reduce flammability.

Small amounts, such as 1% to 3% by weight of high molecular weight polydiorganosiloxane can be added to component (A) of the hydraulic fluids of the present invention, to increase the spray flammability resistance of said hydraulic fluids. Said high molecular weight polydiorganosiloxanes are of the same formula as that hereinabove delineated for component (A) of the compositions of the present invention, with x and y selected so as to result in a viscosity value in excess of 1.00 $m^2$/second, for example, the polydiorganosiloxane having said formula wherein y has a value of 0 and x has a value of approximately 3,000. Said high molecular weight polydiorganosiloxanes are often referred to as silicone gums.

The use, as component (D), of a block copolymer comprising about 90% by weight polydimethylsiloxane blocks and about 10% by weight polybutadiene or hydrogenated polybutadiene blocks is preferred when a silicone gum is to be added to the hydraulic fluid composition of the present invention.

While it is thought that the silicone gum can be added to the polydiorganosiloxane hydraulic fluid additive concentrate of the present invention, to the polydiorganosiloxane hydraulic fluid compositions of the present invention, or to component (A) as hereinabove delineated, addition of the silicone gum to component (A) is preferred.

Preferably, the silicone gum is dissolved in component (A). Component (A) is then incorporated into an hydraulic fluid additive concentrate in the manner hereinabove delineated.

Dissolution of the silicone gum in component (A) can be accomplished by mixing the appropriate amount of gum with component (A) under conditions of shear such that said gum dissolves in a practical span of time. Alternatively, dissolution can be expedited by use of from 10% to 50% of a solvent, such as an aromatic solvent such as toluene or xylene; or an aliphatic solvent such as pentane or hexane. Said solvent can be removed later by separation means, such as distillation.

The polydiorganosiloxane hydraulic fluid compositions of the present invention are stable hydraulic fluids of excellent lubricity.

Accordingly, it is a further object of this invention to provide, in a process of transmitting power from one place to another place, the improvement which comprises using as the hydraulic fluid a composition consisting essentially of (A) 84.5 to 96 parts by weight of a polydiorganosiloxane having a viscosity of from about $1.00\times10^{-5}$ $m^2$/second to about $1.00\times10^{-4}$ $m^2$/second at 25° C., said polydiorganosiloxane having the formula $R'R_2SiO(Me_2SiO)_x(MeRSiO)_ySiR_2R'$, wherein Me represents the methyl radical, each R represents a monovalent radical selected from the group consisting of hydrocarbon radicals containing from 1 to 6 carbon atoms, and halogenated hydrocarbon radicals containing from 1 to 6 carbon atoms, each R' represents a radical selected from the group consisting of R radicals, the hydride radical, and the hydroxy radical, x has an average value of 8 or more and y has an average value of from 0 to about 2, (B) 2.5 to 10 parts by weight of a chlorendate diester having the formula $R''O_2CQCO_2R''$, wherein $—O_2C$-$QCO_2—$ represents the chlorendate residue,

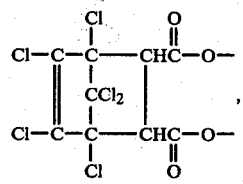

and each R'' represents a radical selected from the group consisting of alkyl radicals containing from 4 to 10 carbon atoms and the tetrahydrofurfuryl radical, (C) 0.5 to 2.5 parts by weight of a lubricant compound selected from the group consisting of N,N-dialkyldithiocarbamates of lead and antimony, and dialkylphosphorodithioates of lead and antimony, and (D) 1 to 3 parts by weight of a block copolymer comprising from about 65% by weight to about 90% by weight polydimethylsiloxane blocks, and from about 10% by weight to about 35% by weight polybutadiene or hydrogenated polybutadiene blocks, the total parts of (A) plus (B) plus (C) plus (D) being 100 parts by weight.

Said process of transmitting power from one place to another place via an hydraulic fluid is accomplished through use of an hydraulic system.

While hydraulic systems vary from highly complex control systems to simple presses, they can be characterized as comprising 6 main elements in fluid communication: (1) an hydraulic fluid; (2) a reservoir in which to store said fluid; (3) means to generate pressure in said fluid, such as a pump or the like; (4) piping, to transmit the generated pressure through said fluid; (5) means to convert said pressure into power at a place removed from the place at which the pressure was generated, such as an hydraulic motor, actuator, cylinder, ram, jack, or the like; and (6) pressure control means, such as control valves, relief valves and the like.

In order to utilize the hydraulic principle, of course, it is necessary for the fluid to be within an enclosed volume able to sustain elevated pressures. Some leakage of fluid is inevitable, and can be tolerated so long as elevated pressures can be sustained.

The polydiorganosiloxane hydraulic fluid compositions of the present invention can be used as the hydraulic fluid in a system for transmitting power from one place to another place as hereinabove described. Advantageously, the hydraulic fluid compositions of the present invention can be used as the hydraulic fluid in hydraulic systems wherein the fluid is exposed to extremes of temperature and high pressure.

The following examples are disclosed to further describe, and teach how to practice, the present invention. These examples are not to be construed as limiting the present invention, which is properly delineated by the appended claims. All parts and percentages are by weight unless otherwise stated. Viscosity values were measured in centistokes at 25° C., and converted to $m^2$/second by multiplying by $1.00\times10^{-6}$ $m^2$/second/centistoke, and rounding the result of said multiplication to three significant figures.

Abbreviations: Herein, the following abbreviations have the indicated meanings:

DBC: Di(n-butyl)chlorendate

DEHC: Di(2-ethylhexyl)chlorendate

Sb-DTC: Antimony-tris{N,N-di(2-ethylhexyl)-dithiocarbamate}

Block copolymer No. 90/10: a block copolymer prepared by co-condensing 90 parts of an hydroxy-endblocked polydimethylsiloxane having a viscosity of $6.00\times10^{-5}$ $m^2$/second to $7.00\times10^{-5}$ $m^2$/second, with 10 parts of an hydroxy-endblocked polybutadiene having a molecular weight of approximately 2,700, using 7.0 parts of the silane $(CH_3)(CH_2{=}CH)Si\{N(CH_3)COCH_3\}_2$ as the coupling agent.

Block copolymer No. 80/20: a block copolymer prepared as described above for block copolymer No. 90/10, except that 80 parts of the hydroxy-endblocked polydimethylsiloxane, 20 parts of the hydroxy-endblocked polybutadiene, and 6 to 8 parts of the silane coupling agent were used.

Block copolymer No. 70/30: a block copolymer prepared as described above for block copolymer No. 90/10, except that 70 parts of the hydroxy-endblocked polydimethylsiloxane, 30 parts of the hydroxy-endblocked polybutadiene, and 6 parts of the silane coupling agent were used.

Block copolymer No. 67/33: a block copolymer prepared as described above for block copolymer No. 90/10, except that 66.7 parts of the hydroxy-endblocked polydimethylsiloxane, 33.3 parts of the hydroxy-endblocked polybutadiene, and 6 parts of the silane coupling agents were used.

Block copolymer No. 90/10H: a block copolymer prepared by the procedure described above for block copolymer No. 90/10, except that approximately 40% of the residual unsaturation of the hydroxy-endblocked polybutadiene had been removed by hydrogenation prior to co-condensation.

Block Copolymer Synthesis:

The above described block copolymers were synthesized by first forming a solution of the above-stated proportions of the hydroxy-endblocked polydimethylsiloxane and hydroxy-endblocked polybutadiene in xylene at a concentration of 25 parts of the two polymers in 75 parts of xylene. This solution was heated to reflux, and a portion of the volatile material taken off to remove any residual water, by way of the water-xylene azeotrope. The thus-dried solution was cooled to 70° C., and the above-stated amount of the silane coupling agent was added to the cooled solution. A rapid coupling reaction followed this addition of the silane coupling agent. This reaction proceeded to completion within a few minutes. The remaining xylene was removed by vacuum distillation of the reaction solution.

Test Procedures

Settling: except where otherwise stated, settling of a composition was determined by placing the composition to be tested in a narrow glass vessel, and allowing the composition-filled vessel to stand at room temperature. After a period of time, the composition-filled vessel was visually examined for the presence of a second phase. Hydraulic fluids that are designated herein as non-settling were allowed to stand for a minimum of five months, with no settling being observed. Settling of a composition results in a loss of lubricity.

Lubricity: Lubricity was determined herein by the general procedure set forth in ASTM D-2596.

Standard 1.27 cm (½ inch) AISI-E-52100 chrome alloy steel balls were thoroughly cleaned and placed in a Shell Four Ball Tester with the appropriate amount of fluid to be tested. High speed testing conditions were: 3300 r.p.m., 25 kg load, 121° C. Low speed testing conditions were: 1200 r.p.m., 40 kg load, 75° C. Testing was one hour in duration. Results of this testing are reported herein as average scar diameter, determined by microscopic examination of the balls at the conclusion of testing. Results are reported in mm, and are reproducible within a range of approximately ±10%.

EXAMPLE 1

An hydraulic fluid concentrate of the present invention was prepared by forming a mixture of 52 parts of hydroxy-endblocked polydimethylsiloxane having a viscosity of $2.00\times10^{-5}$ $m^2$/second, 8 parts of block copolymer No. 80/20, 36 parts of DBC, and 4 parts of Sb-DTC, and agitating said mixture in an Eppenbach high speed mixing apparatus until it acquired the blue tint characteristic of a dispersion having a small average particle size. This concentrate was cloudy and exhibited settling; however, the settled concentrate could be rehomogenized with simple stirring.

EXAMPLE 2

An hydraulic fluid of the present invention was prepared by thoroughly mixing 25 parts of the concentrate of Example 1 with 75 parts of trimethylsiloxy-endblocked polydimethylsiloxane having a viscosity of $2.00\times10^{-5}$ m²/second. This hydraulic fluid was almost clear, and did not settle. See Table I.

EXAMPLE 3

An hydraulic fluid of the present invention was prepared, by the procedure of Example 2, consisting of 18.75 parts of the concentrate of Example 1, and 81.25 parts of trimethylsiloxy-endblocked polydimethylsiloxane having a viscosity of $2.00\times10^{-5}$ m²/second. This hydraulic fluid was clear. See Table I.

EXAMPLE 4

An hydraulic fluid of the present invention was prepared by the procedure of Example 2, said hydraulic fluid consisting of 18.75 parts of the concentrate of Example 1, and 81.25 parts of trimethylsiloxy-endblocked polydimethylsiloxane having a viscosity of $5.00\times10^{-5}$ m²/second. See Table I.

For purposes of comparison, a composition of the art, hereinafter referred to as Comparison i, was prepared. Comparison i was prepared by mixing, until the composition became clear, 93.65 parts of trimethylsiloxy-endblocked polydimethylsiloxane having a viscosity of $5.00\times10^{-5}$ m²/second, 5.7 parts of DEHC, and 0.65 parts of Sb-DTC. See Table I.

The hydraulic fluids of Examples 2,3,4, and Comparison i were tested for lubricity; the results of this testing are displayed in Table I. The compositions of the present invention showed significantly better lubricity than Comparison i.

To determine the relative stabilities of the hydraulic fluids of the present invention and the hydraulic fluids of the art, the hydraulic fluids of Example 4 and Comparison i were placed in a cold box at −15° C. for 7 days to accelerate settling. After this cold-aging cycle, the top ⅓ of the volume of each of the two hydraulic fluids was drawn off without allowing significant mixing with the remainder of the fluid, and the samples withdrawn were tested for lubricity. The results of this testing are displayed in Table I. Note that the sample withdrawn from the hydraulic fluid of the present invention showed substantially the same wear values after the cold-aging cycle, which indicates little or no settling of the additives had taken place. The sample withdrawn from Comparison i showed a marked increase in wear, which indicates loss of additives by settling.

EXAMPLE 5

An hydraulic fluid concentrate of the present invention was prepared as described in Example 1, except that DEHC was used instead of DBC. This concentrate was cloudy, and exhibited settling at room temperature; however, it could be rehomogenized by simple stirring.

EXAMPLE 6

An hydraulic fluid of the present invention was prepared by thoroughly mixing 25 parts of the concentrate of Example 5 with 75 parts of trimethylsiloxy-endblocked polydimethylsiloxane having a viscosity of $5.00\times10^{-5}$ m²/second. This hydraulic fluid was slightly cloudy, but exhibited no settling. See Table II.

EXAMPLE 7

An hydraulic fluid was prepared by mixing together 75 parts of trimethylsiloxy-endblocked polydimethylsiloxane having a viscosity of $5.00\times10^{-5}$ m²/second, 13 parts of trimethylsiloxy-endblocked polydimethylsiloxane having a viscosity of $2.00\times10^{-5}$ m²/second, 9 parts of DEHC, 1 part of Sb-DTC, and 2 parts of block copolymer No. 80/20. This mixture was heated until it became clear, and was then cooled to room temperature. This hydraulic fluid was cloudy, but exhibited no settling. See Table II.

Wear values for Examples 6 and 7 are displayed in Table II. Note that the compositions of Examples 6 and 7 are identical, but that Example 6 was prepared from a concentrate, which is the preferred method of preparation for hydraulic fluids of the present invention.

TABLE II

| | Composition, parts | | | | Average scar diameter, mm | |
|---|---|---|---|---|---|---|
| Example | Polydiorgano-siloxane | DEHC | Sb-DTC | Block Copolymer | High Speed | Low Speed |
| 6[1] | 88 | 9 | 1 | 2 | 0.66 | 0.93 |
| 7[2] | 88 | 9 | 1 | 2 | 1.19 | 1.10 |

[1]Prepared by mixing polydiorganosiloxane with the concentrate of Example 5.
[2]Prepared by direct mixing of the listed materials

EXAMPLES 8–11

Hydraulic fluid concentrates were prepared as described above, in Example 1, with block copolymers No. 90/10, No. 80/20, No. 70/30, and No. 67/33 respectively. These hydraulic fluid concentrates were cloudy and exhibited settling at room temperature; however, each concentrate exhibiting settling could be rehomogenized by simple stirring.

EXAMPLES 12–15

Four hydraulic fluids of the present invention were prepared by mixing each of the concentrates of Examples 8–11 with trimethylsiloxy-endblocked polydimethylsiloxane having a viscosity of $2.00\times10^{-5}$ m²/second,

TABLE I

| | Composition, parts | | | | Average scar diameter, mm | |
|---|---|---|---|---|---|---|
| Example | Polydiorgano-siloxane | DBC | Sb-DTC | Block Copolymer | High Speed | Low Speed |
| 2 | 88 | 9 | 1 | 2 | 0.75 | 1.30 |
| 3 | 91 | 6.75 | 0.75 | 1.5 | 0.75 | 1.04 |
| 4 | 91 | 6.75 | 0.75 | 1.5 | 0.87/0.90[2] | — |
| Comparison i | 93.65 | 5.7[1] | 0.65 | | 01.39/2.47[2] | — |

[1]Comparison i contains DEHC instead of DBC.
[2]Measured on upper ⅓ portion of fluid after aging at −15° C. for 7 days.

25 parts of concentrate and 75 parts of polydiorganosiloxane were used in each example. Components and amounts, as well as average scar diameters for these examples, are displayed in Table III.

TABLE III

| Example No. | Composition, parts: Polydiorganosiloxane | DBC | Sb-DTC | Copolymer No. | Copolymer Amt. | Average scar diameter, mm |
|---|---|---|---|---|---|---|
| 12 | 88 | 7.5 | 2.5 | 90/10 | 2 | 0.93 |
| 13 | 88 | 7.5 | 2.5 | 80/20 | 2 | 0.87 |
| 14 | 88 | 7.5 | 2.5 | 70/30 | 2 | 1.19 |
| 15 | 88 | 7.5 | 2.5 | 67/33 | 2 | 1.23 |

EXAMPLES 16–20

Hydraulic fluid concentrates of the present invention were made by the procedure of Example 1 with block copolymer concentration, block copolymer identity, and DBC concentration varied as shown in Table IV. These concentrates were cloudy and exhibited settling; however, simple stirring was sufficient to rehomogenize each concentrate.

TABLE IV

| Example | Composition, parts: Fluid | DBC | Sb-DTC | Copolymer No. | Copolymer Amount |
|---|---|---|---|---|---|
| 16 | 56 | 20 | 20 | 90/10H | 4 |
| 17 | 52 | 20 | 20 | 90/10H | 8 |
| 18 | 52 | 30 | 10 | 90/10H | 8 |
| 19 | 52 | 36 | 4 | 90/10H | 8 |
| 20 | 56 | 30 | 10 | 90/10 | 4 |

EXAMPLES 21–25

Five hydraulic fluids were prepared by mixing each of the concentrates of examples 16–20 with trimethylsiloxy-endblocked polydimethylsiloxane having a viscosity of $2.00\times10^{-5}$ $m^2$/second. Components and amounts of these hydraulic fluids, along with average scar diameters, are displayed in Table V.

A composition of the art, hereinafter referred to as Comparison ii, was prepared by mixing 90 parts of trimethylsiloxy-endblocked polydimethylsiloxane having a viscosity of $2.00\times10^{-5}$ $m^2$/second, 9 parts of DBC, and 1 part of Sb-DTC, heating the resultant mixture to 70° C., and shaking the heated mixture until it became clear.

TABLE V

| Example | Composition, parts: Fluid | DBC | Sb-DTC | Copolymer No. | Copolymer Amount | Average scar diameter, mm | Cloudy | Settling |
|---|---|---|---|---|---|---|---|---|
| 21 | 94.5 | 2.5 | 2.5 | 90/10H | 0.5 | — | yes | yes |
| 22 | 94 | 2.5 | 2.5 | 90/10H | 1 | 1.13 | slight | no |
| 23 | 88 | 7.5 | 2.5 | 90/10H | 2 | 0.93 | slight | no |
| 24 | 88 | 9 | 1 | 90/10H | 2 | 0.87 | no | no |
| 25 | 89 | 7.5 | 2.5 | 90/10 | 1 | 1.16 | slight | no |
| Comparison ii | 90 | 9 | 1 | — | — | — | yes | yes |

Comparison of Example 21 with Example 22 shows that hydraulic fluids containing a relatively high concentration of Sb-DTC and a relatively low concentration of DBC require about 1 part of block copolymer to provide a non-settling hydraulic fluid.

Comparison of Example 23 with Example 12 (Table III) shows the substantial equivalency of an hydraulic fluid containing block copolymer No. 90/10, and an hydraulic fluid containing block copolymer No. 90/10H, as evidenced by equivalent test results.

Comparison of Example 25 with Example 12 (Table III) shows that superior lubricity is obtained when an additional part of the block copolymer is used in an otherwise equivalent composition. It is not known that the block copolymer is the source of this added lubricity.

Comparison of Example 24 with the composition of the prior art, Comparison ii, shows the superiority of hydraulic fluid compositions of the present invention with respect to settling at room temperature.

That which is claimed is:

1. A composition consisting essentially of (A) 50 to 96 parts by weight of a polydiorganosiloxane having a viscosity of from about $1.00\times10^{-5}$ $m^2$/second to about $1.00\times10^{-4}$ $m^2$/second at 25° C., said polydiorganosiloxane having the formula $R'R_2SiO(Me_2SiO)_x(MeRSiO)_ySiR_2R'$, wherein Me represents the methyl radical, each R represents a monovalent radical selected from the group consisting of hydrocarbon radicals containing from 1 to 6 carbon atoms, and halogenated hydrocarbon radicals containing from 1 to 6 carbon atoms, each R' represents a radical selected from the group consisting of R radicals, the hydride radical, and the hydroxy radical, x has an average value of 8 or more and y has an average value of from 0 to about 2, (B) 2.5 to 40 parts by weight of a chlorendate diester having the formula $R''O_2CQCO_2R''$, wherein $—O_2CQCO_2—$ represents the chlorendate residue,

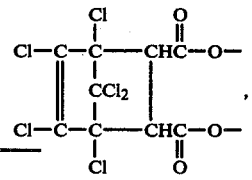

and each R'' represents a radical selected from the group consisting of alkyl radicals containing from 4 to 10 carbon atoms and the tetrahydrofurfuryl radical, (C) 0.5 to 20 parts by weight of a lubricant compound selected from the group consisting of N,N-dialkyldithiocarbamates of lead and antimony, and dialkylphosphorodithioates of lead and antimony, and (D) 1 to 10 parts by weight of a block copolymer comprising from about 65% by weight to about 90% by weight polydimethylsiloxane blocks, and from about 10% by weight to about 35% by weight polybutadiene or hydrogenated polybutadiene blocks, the total parts of (A) plus (B) plus (C) plus (D) being 100 parts by weight.

2. The composition of claim 1 wherein the amount of component (A) is from 50 to less than 84.5 parts by weight, the amount of component (B) is from greater than 10 to 40 parts by weight, the amount of component (C) is from 2.5 to 20 parts by weight, and the amount of component (D) is from greater than 3 to 10 parts by weight.

3. The composition of claim 1 wherein the amount of component (A) is from 84.5 to 96 parts by weight, the amount of component (B) is from 2.5 to 10 parts by weight, the amount of component (C) is from 0.5 to 2.5 parts by weight, and the amount of component (D) is from 1 to 3 parts by weight.

4. The compositions of claim 1 wherein component (A) is trimethylsiloxy-endblocked polydimethylsiloxane having a viscosity of from $2.00\times10^{-5}$ m²/second to about $5.00\times10^{-5}$ m²/second.

5. The composition of claim 2 wherein component (A) is trimethylsiloxy-endblocked polydimethylsiloxane having a viscosity of from $2.00\times10^{-5}$ m²/second to about $5.00\times10^{-5}$ m²/second.

6. The composition of claim 3 wherein component (A) is trimethylsiloxy-endblocked polydimethylsiloxane having a viscosity of from $2.00\times10^{-5}$ m²/second to about $5.00\times10^{-5}$ m²/second.

7. The composition of claim 4 wherein component (B) is selected from the group consisting of di(n-butyl)-chlorendate and di(2-ethylhexyl)chlorendate, and wherein component (C) is antimony-tris{N,N-di(2-ethylhexyl)dithiocarbamate}.

8. The composition of claim 5 wherein component (B) is selected from the group consisting of di(n-butyl)-chlorendate and di(2-ethylhexyl)chlorendate, and wherein component (C) is antimony-tris{N,N-di(2-ethylhexyl)dithiocarbamate}.

9. The composition of claim 6 wherein component (B) is selected from the group consisting of di(n-butyl)-chlorendate and di(2-ethylhexyl)chlorendate, and wherein component (C) is antimony-tris{N,N-di(2-ethylhexyl)dithiocarbamate}.

10. A composition as recited in claim 3 wherein component (A) consists of from about 97% to about 99% by weight of a polydiorganosiloxane having a viscosity of less than $1.00\times10^{-4}$ m²/second and from about 1% to about 3% by weight of a polydiorganosiloxane gum having a viscosity greater than about 1 m²/second, and wherein component (D) comprises about 90% by weight of polydimethylsiloxane segments and about 10% by weight of polybutadiene or hydrogenated polybutadiene segments.

11. In a process of transmitting power from one place to another place via an hydraulic fluid, the improvement which comprises using as the hydraulic fluid a composition consisting essentially of (A) 84.5 to 96 parts by weight of a polydiorganosiloxane having a viscosity of from about $1.00\times10^{-5}$ m²/second to about $1.00\times10^{-4}$ m²/second at 25° C., said polydiorganosiloxane having the formula $R'R_2SiO(Me_2SiO)_x(MeRSiO)_ySiR_2R'$, wherein Me represents the methyl radical, each R represents a monovalent radical selected from the group consisting of hydrocarbon radicals containing from 1 to 6 carbon atoms, and halogenated hydrocarbon radicals containing from 1 to 6 carbon atoms, each R' represents a radical selected from the group consisting of R radicals, the hydride radical, and the hydroxy radical, x has an average value of 8 or more and y has an average value of from 0 to about 2, (B) 2.5 to 10 parts by weight of a chlorendate diester having the formula $R''O_2CQCO_2R''$, wherein $—O_2CQCO_2—$ represents the chlorendate residue,

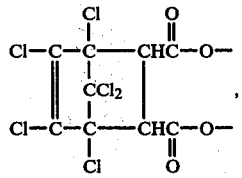

and each R'' represents a radical selected from the group consisting of alkyl radicals containing from 4 to 10 carbon atoms and the tetrahydrofurfuryl radical, (C) 0.5 to 2.5 parts by weight of a lubricant compound selected from the group consisting of N,N-dialkyldithiocarbamates of lead and antimony, and dialkylphosphorodithioates of lead and antimony, and (D) 1 to 3 parts by weight of a block copolymer comprising from about 65% by weight to about 90% by weight to about 35% by weight polybutadiene or hydrogenated polybutadiene blocks, the total parts of (A) plus (B) plus (C) plus (D) being 100 parts by weight.

12. The process of claim 11 wherein component (A) is trimethylsiloxy-endblocked polydimethylsiloxane having a viscosity of from $2.00\times10^{-5}$ m²/second to about $5.00\times10^{-5}$ m²/second.

13. The process of claim 11 wherein component (B) is selected from the group consisting of di(n-butyl)chlorendate and di(2-ethylhexyl)chlorendate, and wherein component (C) is antimony-tris{N,N-di(2-ethylhexyl)-dithiocarbamate}.

14. The process of claim 12 wherein component (B) is selected from the group consisting of di(n-butyl)chlorendate and di(2-ethylhexyl)chlorendate, and wherein component (C) is antimony-tris{N,N-di(2-ethylhexyl)-dithiocarbamate}.

15. The process of claim 11 wherein component (A) consists of from about 97% to about 99% by weight of a polydiorganosiloxane having a viscosity of less than $1.00\times10^{-4}$ m²/second, and from about 1% to about 3% by weight of a polydiorganosiloxane gum having a viscosity greater than 1 m²/second, and component (D) comprises about 90% by weight polydimethylsiloxane segments and about 10% by weight polybutadiene or hydrogenated polybutadiene segments.

16. The process of claim 13 wherein component (A) consists of from about 97% to about 99% by weight of a polydiorganosiloxane having a viscosity of less than $1.00\times10^{-4}$ m²/second, and from about 1% to about 3% by weight of a polydiorganosiloxane gum having a viscosity greater than 1 $m^2$/second, and component (D) comprises about 90% by weight polydimethylsiloxane segments and about 10% by weight polybutadiene or hydrogenated polybutadiene segments.

17. A method for producing polydiorganosiloxane hydraulic fluids, said method comprising mixing together (I) from 70 to 85 parts by weight of a polydiorganosiloxane having a viscosity of from about $1.00\times10^{-5}$ $m^2$/second to about $1.00\times10^{-4}$ $m^2$/second at 25° C., said polydiorganosiloxane having the formula $R'R_2SiO(Me_2SiO)_x(MeRSiO)_ySiR_2R'$ wherein Me represents the methyl radical, each R represents a monovalent radical selected from the group consisting of hydrocarbon radicals containing from 1 to 6 carbon atoms, and halogenated hydrocarbon radicals containing from 1 to 6 carbon atoms, each R' represents a radical selected from the group consisting of R radicals, the hydride radical, and the hydroxy radical, x has an average value of 8 or more and y has an average value of from 0 to about 2, and (II) from about 15 to about 30 parts by weight of a composition consisting essentially of (A) 50 to less than 84.5 parts by weight of a polydiorganosiloxane having a viscosity of from about $1.00\times10^{-5}$ $m^2$/second to about $1.00\times10^{-4}$ $m^2$/second at 25° C., said polydiorganosiloxane having the formula $R'R_2SiO(Me_2SiO)_x(MeRSiO)_ySiR_2R'$ wherein Me represents the methyl radical, each R represents a monovalent radical selected from the group consisting of hydrocarbon radicals containing from 1 to 6 carbon atoms, and halogenated hydrocarbon radicals containing from 1 to 6 carbon atoms, each R' represents a radical selected from the group consisting of R radicals, the hydride radical, and the hydroxy radical, x has an average value of 8 or more and y has an average value of from 0 to about 2, (B) from greater than 10 to 40 parts by weight of a chlorendate diester having the formula $R''O_2CQCO_2R''$, wherein $—O_2CQCO_2—$ represents the chlorendate residue,

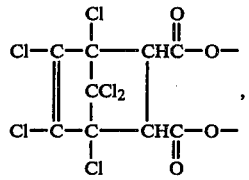

and each R'' represents a radical selected from the group consisting of alkyl radicals containing from 4 to 10 carbon atoms and the tetrahydrofurfuryl radical, (C) from greater than 2.5 to 20 parts by weight of a lubricant compound selected from the group consisting of N,N-dialkyldithiocarbamates of lead and antimony, and dialkylphosphorodithioates of lead and antimony, and (D) from greater than 3 to 10 parts by weight of a block copolymer comprising from about 65% by weight to about 90% by weight polydimethylsiloxane segments, and from about 10% by weight to about 35% by weight polybutadiene or hydrogenated polybutadiene segments, the total parts of (A) plus (B) plus (C) plus (D) being 100 parts by weight, and the total parts of (I) plus (II) being 100 parts by weight.

18. The method of claim 17 wherein component (I) is trimethylsiloxy-endblocked polydimethylsiloxane having a viscosity of from about $2.00\times10^{-5}$ $m^2$/second to about $5.00\times10^{-5}$ $m^2$/second.

19. The method of claim 17 wherein component (A) is trimethylsiloxy-endblocked polydimethylsiloxane having a viscosity of from about $2.00\times10^{-5}$ $m^2$/second to about $5.00\times10^{-5}$ $m^2$/second.

20. The method of claim 17 wherein component (B) is selected from the group consisting of di(n-butyl)chlorendate and di(2-ethylhexyl)chlorendate, and wherein component (C) is antimony-tris{N,N-di(2-ethylhexyl)-dithiocarbamate}.

21. The method of claim 18 wherein component (B) is selected from the group consisting of di(n-butyl)chlorendate and di(2-ethylhexyl)chlorendate, and wherein component (C) is antimony-tris{N,N-di(2-ethylhexyl)-dithiocarbamate}.

22. The method of claim 19 wherein component (B) is selected from the group consisting of di(n-butyl)chlorendate and di(2-ethylhexyl)chlorendate, and wherein component (C) is antimony-tris{N,N-di(2-ethylhexyl)-dithiocarbamate}.

* * * * *

UNITED STATES PATENT AND TRADEMARK OFFICE

CERTIFICATE OF CORRECTION

PATENT NO. : 4,443,351

DATED : April 17, 1984

INVENTOR(S) : Joseph W. Keil

It is certified that error appears in the above-identified patent and that said Letters Patent is hereby corrected as shown below:

Col. 3, Line 40 delete "are" and substitute --as--.

Signed and Sealed this

Fourth Day of September 1984

[SEAL]

*Attest:*

GERALD J. MOSSINGHOFF

*Attesting Officer*

*Commissioner of Patents and Trademarks*